US007618301B2

(12) United States Patent
Knight et al.

(10) Patent No.: US 7,618,301 B2
(45) Date of Patent: Nov. 17, 2009

(54) FOLD-OUT PLAYSETS WITH POP-UP STRUCTURES

(75) Inventors: James Knight, Pasadena, CA (US); Julian Payne, Los Angeles, CA (US); Kwun Chung Mo, Hong Kong (CN); Alan Cheung, Hong Kong (CN); Pitt Lau, Hong Kong (CN)

(73) Assignee: Mattel, Inc., El Segundo, CA (US)

( * ) Notice: Subject to any disclaimer, the term of this patent is extended or adjusted under 35 U.S.C. 154(b) by 256 days.

(21) Appl. No.: 11/446,404

(22) Filed: Jun. 2, 2006

(65) Prior Publication Data

US 2006/0286891 A1 Dec. 21, 2006

Related U.S. Application Data

(60) Provisional application No. 60/687,370, filed on Jun. 3, 2005, provisional application No. 60/691,480, filed on Jun. 16, 2005, provisional application No. 60/717,083, filed on Sep. 13, 2005.

(51) Int. Cl.
*A63H 33/04* (2006.01)
*A63H 33/00* (2006.01)

(52) U.S. Cl. ..... 446/75; 446/478

(58) Field of Classification Search ..... 446/71–75, 446/478, 487, 486

See application file for complete search history.

(56) References Cited

U.S. PATENT DOCUMENTS 243,873 A 7/1881 Dorn et al.
565,450 A 8/1896 Gibson
930,108 A 8/1909 Walcutt (Continued)

FOREIGN PATENT DOCUMENTS

EP 555188 A1 1/1993

(Continued)

OTHER PUBLICATIONS

Jackson, Paul, The Pop-Up Book, 1993, pp. 3,4, 30, 37, 50, 53, 58, 59, 64, 66, 78, 79, 84, 85, 86, 87, 89, 90, 91, 111, 132, 133, 141, 142, 143, 144, 146, 149, 150, 151, 152, 153, & 158, Henry Holt and Company, LLC., New York, NY.

(Continued)

*Primary Examiner*—Kien T Nguyen
(74) *Attorney, Agent, or Firm*—Kolisch Hartwell, P.C.

(57) ABSTRACT

Playsets having pop-up structures. Pop-up structures may be adapted to transition to an erect configuration when the playset is in an open configuration, in which at least a portion of the pop-up structure may extend outside of a perimeter of the playset, and to a compact stowed configuration when the playset is in a closed configuration, in which the pop-up structure is disposed within the perimeter. Playsets may include elements adapted to urge a portion of the pop-up structure toward the erect configuration or one or more playset-accessory retention chambers. Some examples may include first and second latch elements that are adapted to cooperatively retain the playset in the open configuration. Other examples may include a fastener adapted to be moved selectively between a clasping position in which the fastener retains the playset in the closed configuration and a linking position in which the fastener couples to a second playset.

23 Claims, 15 Drawing Sheets

U.S. PATENT DOCUMENTS 953,168 A 3/1910 Hamilton
990,918 A 5/1911 Stadler
1,008,195 A 11/1911 Prichard
1,258,788 A 3/1918 Koch
1,430,778 A 10/1922 Williams
1,549,610 A 8/1925 Reisz
1,551,666 A 9/1925 Jensen et al.
1,819,932 A 8/1931 Walden
1,841,041 A 1/1932 Lowenstein
1,844,816 A 2/1932 Brown
1,870,395 A 8/1932 Zarin
1,914,116 A 6/1933 Ford
1,992,618 A 2/1935 Jeffreys
2,148,279 A 2/1939 Sandberg
2,221,267 A 11/1940 Robertson
2,234,739 A * 3/1941 Murrell ..... 223/106
2,458,879 A 1/1949 Schenk
2,475,471 A 7/1949 Brown et al.
2,544,783 A 3/1951 Freedman et al.
2,648,847 A 8/1953 Crowder
2,735,109 A 2/1956 Feldman
2,837,863 A 6/1958 Duvall
2,872,753 A 2/1959 Fenton
2,992,598 A 7/1961 Einfalt
3,048,941 A 8/1962 Shaw
3,108,398 A 10/1963 Einfalt
3,182,420 A 5/1965 Bender
3,228,139 A 1/1966 Lohnes
RE26,642 E 8/1969 Bender
3,629,875 A 12/1971 Dow et al.
D233,458 S 10/1974 Relling
3,880,429 A 4/1975 Blumenaus
4,030,234 A 6/1977 Allen et al.
4,030,235 A * 6/1977 Terzian et al. ..... 446/296
4,067,137 A * 1/1978 Korthase ..... 446/478
4,070,789 A 1/1978 Levenson
4,130,284 A 12/1978 Fuks
4,139,967 A 2/1979 Kuna et al.
4,146,983 A 4/1979 Penick et al.
4,165,579 A * 8/1979 Chase ..... 446/73
D254,982 S 5/1980 Fratarcangeli
4,212,231 A 7/1980 Penick et al.
D258,323 S 2/1981 Lewis
4,254,576 A 3/1981 Matsumoto et al.
4,321,708 A 3/1982 Troiano
4,337,589 A 7/1982 Volkert et al.
4,349,973 A 9/1982 Penick et al.
4,349,983 A 9/1982 Kilroy et al.
4,365,438 A 12/1982 Nelson
D267,570 S 1/1983 Argandona
D269,360 S 6/1983 Ng
4,433,504 A 2/1984 Terui
4,468,020 A 8/1984 Wallace
4,536,162 A 8/1985 Ace, Jr. et al.
D282,385 S 1/1986 Argandona
4,575,348 A 3/1986 Wiggs et al.
4,581,904 A 4/1986 Lehmann et al.
D284,328 S 6/1986 Bieber
4,592,573 A 6/1986 Crowell
D288,453 S 2/1987 Takasaka et al.
4,657,612 A 4/1987 Schoenleber et al.
4,661,080 A 4/1987 Goldstein et al.
4,685,728 A 8/1987 Rebollo
4,712,673 A 12/1987 Moore
4,774,780 A 10/1988 Crowell
4,793,006 A 12/1988 Dawson
D303,407 S 9/1989 Mazzocco
4,883,443 A 11/1989 Chase
4,898,404 A 2/1990 Babcock
4,910,899 A 3/1990 Alperin
4,937,207 A 6/1990 Simmell et al.
4,946,413 A 8/1990 Lehmann et al.
4,961,716 A * 10/1990 Hippely et al. ..... 446/75
4,964,249 A 10/1990 Payne
4,985,935 A 1/1991 Hur
5,004,445 A * 4/1991 Coleman et al. ..... 446/478
5,013,278 A 5/1991 Dixon et al.
5,019,010 A 5/1991 Nikaido et al.
5,022,681 A 6/1991 Penick
5,049,078 A 9/1991 Thomsen
5,096,204 A 3/1992 Lippman
5,104,124 A 4/1992 Bernard et al.
5,213,507 A 5/1993 Ozrovitz
5,259,133 A 11/1993 Burtch
5,293,706 A 3/1994 Wood
5,317,823 A 6/1994 Brunt, II
5,356,155 A 10/1994 Gross
5,358,252 A 10/1994 McPaul
5,360,028 A 11/1994 Jasin
5,452,846 A 9/1995 Myers
D366,290 S 1/1996 Dieudonne
5,480,335 A 1/1996 Caveza
5,525,088 A 6/1996 Mayne
5,542,870 A 8/1996 Westersund
5,562,520 A 10/1996 Prindonoff et al.
5,613,612 A 3/1997 Davault
D383,507 S 9/1997 Bro et al.
5,681,199 A 10/1997 Morris
5,682,999 A 11/1997 Larson
5,738,221 A 4/1998 Van Witt et al.
D394,476 S 5/1998 Blumenthal
5,758,777 A 6/1998 Dods
5,820,436 A * 10/1998 Pohlman ..... 446/75
5,830,033 A 11/1998 Piron
5,839,937 A 11/1998 Thomas
5,864,973 A 2/1999 Cole
5,868,599 A 2/1999 Kaufman
5,931,099 A 8/1999 Bruner et al.
5,933,989 A 8/1999 Volkert et al.
5,943,800 A 8/1999 Rose
5,961,149 A 10/1999 Hunt
6,099,380 A 8/2000 Rasmussen
6,138,701 A 10/2000 Zheng
6,146,238 A 11/2000 Daiber
6,199,308 B1 3/2001 Westendorp
6,203,017 B1 3/2001 Schultz
6,283,819 B1 9/2001 Polinger et al.
6,311,142 B1 10/2001 Glassner
6,386,370 B1 5/2002 Wigton et al.
6,554,685 B2 4/2003 Lish
6,572,436 B1 6/2003 So
6,684,894 B2 2/2004 Zheng
6,725,588 B1 4/2004 Swoboda
6,752,164 B1 6/2004 Park
6,871,853 B2 3/2005 Bedford
6,966,135 B1 11/2005 McDonald
D554,202 S 10/2007 Knight et al.
D554,203 S 10/2007 Knight et al.
D555,210 S 11/2007 Knight et al.
D555,211 S 11/2007 Knight et al.
D555,212 S 11/2007 Knight et al.
2002/0105143 A1 8/2002 Elliott et al.
2002/0106969 A1 8/2002 Lish
2003/0090060 A1 5/2003 Bedford
2003/0090062 A1 5/2003 Bedford
2003/0094757 A1 5/2003 Bedford
2004/0266316 A1 12/2004 Li et al.
2005/0090178 A1 4/2005 Snyder
2005/0112985 A1 5/2005 Ciccarelli et al.
2005/0153630 A1 7/2005 Delaney et al.
2005/0164594 A1 7/2005 Garr
2006/0021905 A1 2/2006 Johnson
2006/0040582 A1 2/2006 Hopper et al.
2006/0099874 A1 5/2006 Cartlidge et al.

2006/0099875 A1 5/2006 Cartlidge et al.

FOREIGN PATENT DOCUMENTS

| | | | |
|---|---|---|---|
| EP | 647930 | B1 | 10/1994 |
| GB | 2159721 | A | 12/1985 |
| GB | 2178331 | A | 7/1986 |
| GB | 2245251 | A | 1/1992 |
| GB | 2295044 | A | 5/1996 |
| GB | 2310421 | A | 8/1997 |
| WO | 93/11843 | | 6/1993 |
| WO | 97/09102 | | 3/1997 |
| WO | 97/30912 | | 8/1997 |

OTHER PUBLICATIONS

PCT International Search Report and Written Opinion for PCT/US06/21696.
Lothar Meggendorfer, Pop-up Book, 1899.
1989 Mattel Catalog, pp. 20, 38, 124, 126.
The Tale of Jemima Puddle-Duck, 1991, photograph of book.
1992 Mattel Girls Catalog, pp. 56, 105, and unnumbered page showing Barbie Play 'N Carry House.
1993 ARCO Catalog, pp. 17-20, Disney Playsets.
1993 Mattel Catalog page Snow White Magical Vanity.
Paul Jackson, Henry Holt, The Pop-Up Book, three pages, 1993.
Pop-Up Box of Colors, 1994, 15 photographs of book.
Galoob Micro Machines playsets, 1995, five photographs.
1998 Arcotoys Catalog, p. 164.
1998 Fisher-Price Catalog, p. 94.
1998 Galoob Catalog pages, "Backpack Club" (copyright 1997).
Michael Welply and Dawn Bentley, The Fairytale Village Pop-Up Playset, The Book Workshop, copyright 1998, three photographs.
Golden Bear 1999 Collection, p. 10.
1999 Mattel Catalog, p. 162.
Adventures in Dwarfland, 2000, photograph of book.
2000 Mattel Catalog, p. 156.
Mattel Matchbox Hero City Take-A-Long playsets, 2003, photograph of toys.
Mattel Matchbox Car Wash Playset Instruction Sheet, 2003.
Mattel Matchbox Rocket Park Playset Instruction Sheet, 2004.
Mattel Matchbox Instruction Sheet G3711, 2004.
2004 Mattel Catalog, page showing Matchbox take-along playsets.
2005 Little Tikes Catalog, pp. 14 and 15.
Matchbox Hero city Instructions Sheet, 2002.
Sabrina fold-out Playhouse, circa 2005, photograph of item.
Hugh Johnson, Ron Van Der Meer, pop-up wine book, 1989, Harper and Row, photograph of book.
Little Tikes toy, photograph.
Pelham Sams Pizza, 1996, Dutton Children's Books Hedgehog Books Limited, photograph of book.
Thomas the Tank Engine Playhouse, photograph.
Shoot The Moon book with playset, 2004, photograph of toy.
Shoot The Moon cottage playset, 2002, photograph of toy.
Karin Roberts, Kelly Popup Playhouse, copyright 2006, three photographs showing package and toy.
Barbie Playground Sisters dolls Pop-up Playground, 2006, two photographs of package.
Playmates Toys Speedez Hummer H2 Speed City, 2004, printout from eToys webpage on Aug. 16, 2006.
Ali Baba and the Forty Thieves Peepshow Book, 1950, Ionicus Houghton Mifflin, photograph of item.
Architecture Pack by Van der Meer, 1996, photograph of book.
1990 Mattel Boys Toys Catalog, pp. 38, and 52-53.
Kall-Kwik-printer advertisement, 1987, photograph of item.
Little Pets Panorama picture book Bavaria London, Nister; New York, E P Dutton, 1896, photograph of book.
Mattel Barbie playhouse, circa 1968, photograph of item.
Mattel Fold Out playset, 1994, two photographs of toy.
Noah's Ark Full of Animals—A Pop-Up Playbook, circa 1994, Tyndale, photographs of book.
Polly Pocket Pop-Up Playsets, Bluebird, 1996, nine photographs.
Wallace Berrie, Smurf Pop-Up Playset, 1983, four photographs.
The Nativity Pop-up, Van der Meer, 1997, photograph of item.
Fall 2005 Mattel Catalog, page showing Barbie® Sweet Dreams Bed & Bath.
Barbie-Kelly Pop-Up Playhouse, circa Jun. 2005, five photographs of toy and packaging.
Hamtaro Popup Playset Kawai, circa Apr. 2003, photograph of item.

* cited by examiner

FOLD-OUT PLAYSETS WITH POP-UP STRUCTURES

RELATED APPLICATIONS

The present application claims the benefit of U.S. Provisional Patent Application Ser. No. 60/687,370, filed on Jun. 3, 2005, U.S. Provisional Patent Application Ser. No. 60/691,480, filed on Jun. 16, 2005, and U.S. Provisional Patent Application Ser. No. 60/717,083, filed on Sep. 13, 2005, the complete disclosures of which are hereby incorporated by reference herein in their entirety and for all purposes.

TECHNICAL FIELD

The present disclosure relates generally to amusement devices, and more particularly to amusement devices that include fold-out playsets that may have pop-up structures.

BACKGROUND OF THE DISCLOSURE

A playset may include a shell, and a pop-up structure. Examples of fold-out, pop-up playsets, or more generally playsets or other amusement devices with folding construction are found in U.S. Pat. Nos. 243,873, 565,450, 930,108, 953,168, 990,918, 1,00,195, 1,258,788, 1,430,778, 1,551,666, 1,841,041, 1,844,816, 1,870,395, 1,819,932, 1,914,116, 1,992,618, 2,148,279, 2,221,267, 2,458,879, 2,475,471, 2,544,783, 2,648,847, 2,735,109, 2,872,753, 3,108,398, 3,182,420, 3,228,139, 4,030,235, 4,030,234, 4,070,789, 4,337,589, 4,139,967, 4,321,708, 4,130,284, 4,349,973, 4,349,983, 4,365,438, 4,536,162, 4,575,348, 4,657,612, 4,661,080, 4,712,673, 4,774,780, 4,793,006, 4,883,443, 4,898,404, 4,937,207, 4,964,249, 4,946,413, 4,985,935, 5,013,278, 5,019,010, 5,022,681, 5,049,078, 5,096,204, 5,104,124, 5,259,133, 5,293,706, 5,317,823, 5,356,155, 5,480,335, 5,542,870, 5,562,520, 5,613,612, 5,681,199, 5,682,199, 5,682,999, 5,738,221, 5,830,033, 5,839,937, 5,864,973, 5,931,099, 5,943,800, 5,961,149, 6,099,380, 6,146,238, 6,199,308, 6,203,017, 6,311,142, 6,554,685, 6,572,436, 6,725,588, 6,871,853, D258,323, RE26642, in U.S. Patent Application Publication Nos. 2002/0105143, 2002/0106969, 2003/0090060, 2003/0090062, 2003/0094757, 2004/0266316, 2005/0112985, 2005/0153630, 2006/0021905, 2006/0040582, and 2006/0099875, and in EP 555188A1, EP0647930B1, GB2159721A, GB2178331A, GB2178331A, GB2245251A, GB2295044A, GB2310421A, and WO 97/30912, the disclosures of which are hereby incorporated herein by reference in their entirety for all purposes.

SUMMARY OF THE DISCLOSURE

A playset may include a pop-up structure that is adapted to transition to an erect configuration when the playset is in an open configuration, in which at least a portion of the popup structure may extend outside of a perimeter of the playset, and to transition to a compact stowed configuration when the playset is in a closed configuration, in which the pop-up structure is disposed within the perimeter. Optionally, playsets may include elements that are adapted to urge a portion of the pop-up structure toward the erect configuration. Playsets may include one or more playset-accessory retention chambers. Some examples may include first and second latch elements that are adapted to cooperatively retain the playset in the open configuration. Other examples may include a fastener that is adapted to be moved selectively between a clasping position in which the fastener is retaining the playset in the closed configuration and a linking position in which the fastener is coupled to a second playset.

DETAILED DESCRIPTION OF THE DISCLOSURE

Playsets that simulate miniaturized operating environments for automobiles, trucks, airplanes, boats, and the like have been a popular toy for many years. The disclosed playsets include platforms, ramps, cranes, and other structures that pop up from a folded, stored position to an erect, play configuration when the playset is opened from a closed configuration resembling a briefcase or suitcase. The fold-out, pop-up nature of these playsets has been found to provide superior play and storage value, because the playsets can be linked, and closed up and either stored or transported easily.

Figure 1:
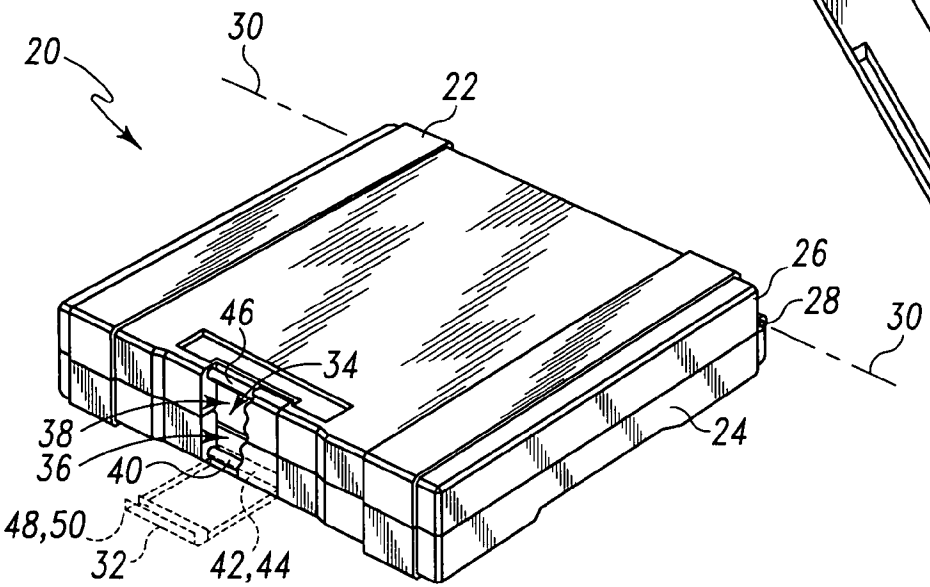
FIG. 1 is a perspective view of a playset in a closed configuration.
Figure 2:
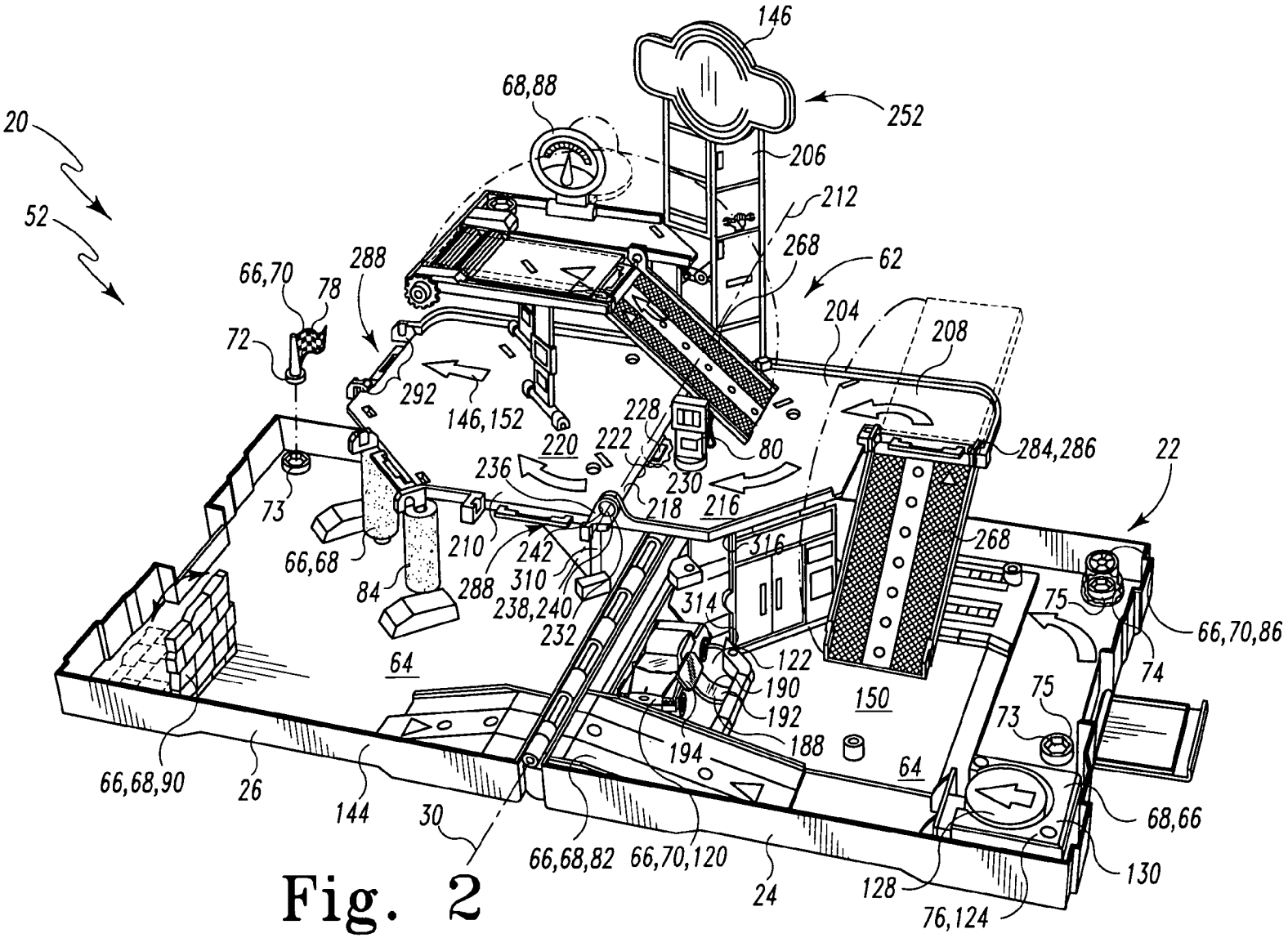
FIGS. 2-6 are perspective views of several exemplary playsets, each in an open configuration.

An example of a fold-out playset with pop-up structures is shown in FIG. 1 and indicated generally at 20. Playset 20 is shown in a folded or closed configuration in which the playset may resemble a suitcase or a briefcase. In this condition, playset 20 may be suitable for compact storage or transport without exposing the inside parts to elements which might damage them. The playset may include a shell 22 formed by a first shell member 24, a second shell member 26, and a shell hinge 28 that couples the first shell member to the second shell member at a shell hinge axis 30. Playset 20 may also include a clasp or fastener 32 that may be adapted to secure shell members 24 and 26 together in the closed configuration and/or to link playset 20 to another playset or toy, as is described in greater detail below.

The fastener shown in FIG. 1 is shown in a clasping position in which it is operatively coupled to the first shell member and to the second shell member, thereby retaining playset 20 in the closed position. In some embodiments, first and second shell members 24, 26 may each include a recess portion 34, 36. When playset 20 is in the closed configuration, the recess portions may collectively form a recess 38. Fastener 32 may nest in the recess when coupled to the second shell member.

In some embodiments, the fastener may be pivotably coupled to first shell member 24 and/or may be selectively removed from the first shell member manually. FIG. 1 also shows a fastener 32 pivoted away from second shell member 26. The first shell member may include a first cylindrical member, or bar, 40. Fastener 32 may be adapted to engage and/or rotate about the first cylindrical member. Accordingly, the fastener may include a first channel 42 having a first open side 44 that may be adapted to receive the first cylindrical member.

The second shell member may include a second cylindrical member 46 that may be similar in size and/or shape as the first cylindrical member, and that may be adapted to couple the fastener to the second shell member. Similarly, fastener 32 may include a second channel 48 having a second open side 50 that may be adapted to receive the second cylindrical member. In some examples, first channel 42 and/or second channel 48 may be formed from a resilient material.

The shell members may be adapted to be transitioned between the closed configuration shown in FIG. 1, in which the shell members are facing each other and an open configuration, in which the shell members are spaced apart. FIGS. 2-6 show five embodiments of playset 20, in the open configuration. Each of the playsets may embody a specific play theme, with the adornments and structures of the playset illustrating aspects of that theme. For example, playset 52 may embody an auto center theme, and the adornments and structures of the playset illustrating auto repair and/or servicing stations, carwashes, and the like. Similarly, playset 54 may embody a harbor patrol theme with illustrations of a harbor, an airport/heliport, and the like. Playset 56 may embody a snake jungle theme with illustrations of jungle forts. Playset 58 may embody a construction zone theme, with illustrations of scaffolding, cranes, and the like. Playset 60 may embody a dragon castle theme, with illustrations of a dragon, a castle, and the like.

Figure 7:
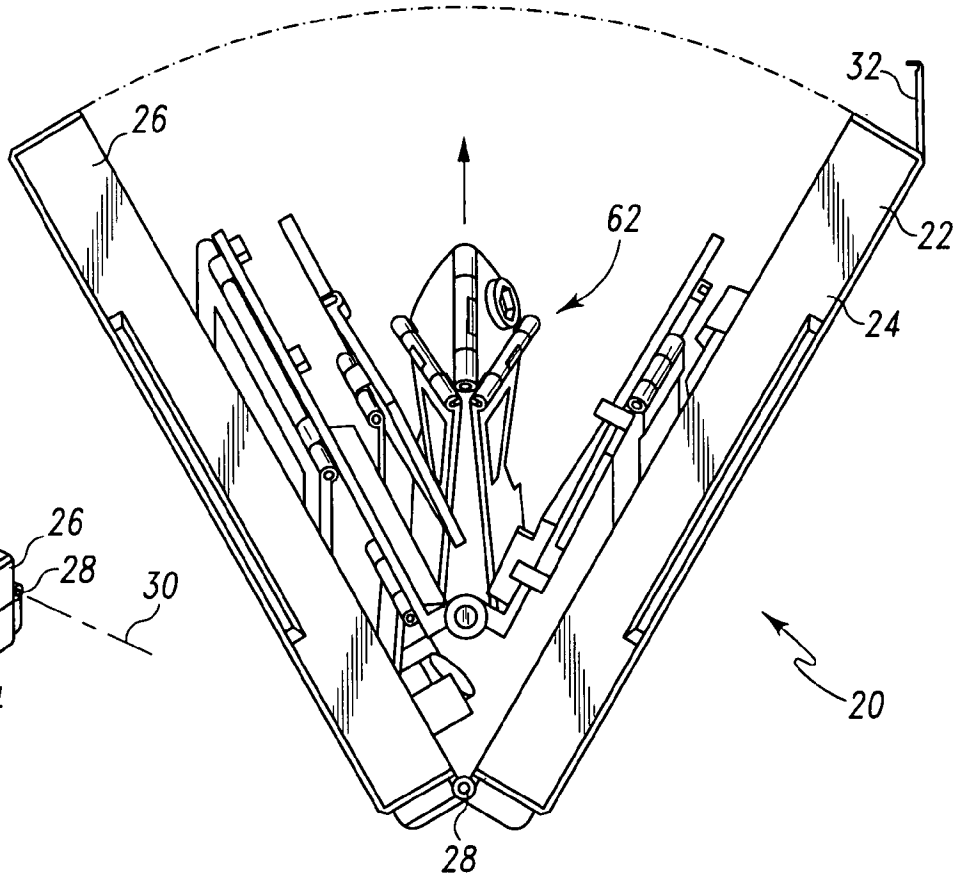
FIG. 7 is a side view of a playset transitioning between a closed configuration and an open configuration.

When playsets 20 are transformed from the closed configuration shown in FIG. 1 to the open configuration shown in FIGS. 2-6, pop-up structure 62 may be transitioned from a stowed configuration in which the pop-up structure is collapsed and extends along a support surface 64 of shell 22 to a deployed configuration, in which the support structure may stand substantially transverse to the support surface and one or both shell members. The pop-up structure may be adapted to be selectively transitioned between these aforementioned configurations by a user. Alternatively, the pop-up structured may be configured to transition from the stowed configuration to the deployed configuration, or vice versa, when the playset is transitioned from the open configuration to the closed configuration. FIG. 7 shows a playset 20 that is between the fully opened and closed configurations.

Playsets 20 may include one or more elements that add play value, such as accessories 66. The accessories may include one or more fixed accessories 68 that may be in a fixed position on the shell and/or the pop-up structure and one or more movable accessories 70. Movable accessories may include at least one extension 72 that may be adapted to be received in one or more accessory mounting apertures 73 and/or at least one collar 74 that may be adapted to receive one or more mounting projections 75. Mounting apertures and mounting projections, which may be provided as a common element, may be disposed in multiple locations on an interior or support surface 64 of shell 22 and/or on pop-up structure 62. As shown, accessory mounting apertures 73 have a hexagonal interior that may be recessed or may be formed with a raised ridge, although other shapes and structures are possible. Extensions 72 may have a hexagonal shape that is adapted to mate with the interior of the accessory mounting apertures. Alternatively, the extensions may have a round shape that is adapted to fit inside the accessory mounting apertures such that the movable accessories are adapted to rotate within the accessory mounting apertures. Optionally, accessories may have apertures that receive extensions attached to support surface 64 and or to pop-up structure 62.

Non exclusive examples of accessories 66 may include a launcher 76, a flag 78, a gas pump 80, a jumping ramp 82, a carwash 84, a tire wrench 86, a tachometer 88, a collapsible wall 90, a wind sock 92, a radar dish 94, binoculars 96, an amulet 98, a launching platform 100, a spring-loaded trap 102, a zip line 104, a barrier 106, a crane 108, a roof truss 110, a treasure chest 112, a door 114, a trap door 116, a dragon 118, a vehicle 120, and an accessory retention chamber 122. Each playset may include any number of specific accessories that illustrate the particular theme of the playset. Moreover, one or more accessories may be included with multiple playsets, one or more accessories may have a different structure and appearance for each playset, and accessories may be used with more than one playset.

For example, playsets 52, 54, 58, and 60 each include a launcher 76, which may be considered either a fixed launcher 124 or a movable launcher 126. Fixed launcher 124 may be a fixed accessory 68 of playsets 20, or specifically of playsets 52 and 54. The fixed launcher may be formed by a lever arm 128 that is pivotably coupled to a base 130 such that pressing upon a first end of the lever arm causes the lever arm to pivot such that a second end of the lever arm propels one or more vehicles 120 across support surface 64.

Movable launcher 126 may be a movable accessory of playsets 20, or specifically of playsets 58 and 60. For example, cement mixer launcher 132 of playset 58 is adapted to be inserted into one or more accessory mounting apertures 73. The launcher may be adapted to propel one or more vehicles 120 when a spring loaded portion 134 is pulled back at a first end 136 and released when a vehicle is placed against a second end 138. Crossbow launcher 140 may include a lever arm 128 that is coupled to a movable base 142.

Various playsets may include one or more jumping ramps 82 that are disposed in various configurations. For example, the jumping ramps may be disposed in alignment with a fixed launcher 124, may be configured in a paired arrangement that straddles shell hinge 28, and/or may lead to the edge of shell perimeter 144. Additionally or alternatively, jumping ramps 82 may be straight or may be curved.

Playsets 20 may include one or more scenery elements 146, which may also be considered an accessory 66. For example, playset 54 shown in FIG. 3 includes a lighthouse 148. The lighthouse may be adapted to be pivoted between a deployed position, in which the lighthouse stands transverse to support surface 64, and a stowed position, in which the lighthouse extends along the support surface. Other embodiments may include various scenery elements 146 that are formed or coupled to a surface liner 150 that is operatively coupled to one or both shell members and/or the support surface, and/or formed or coupled to the pop-up structure. Scenery elements 146 may be affixed to the support surface and/or the pop-up structure as applied decals, as painted images and/or as fastened elements. Examples of alternative scenery elements may include graphic elements 152, helipad 154, and the like.

Figure 4:
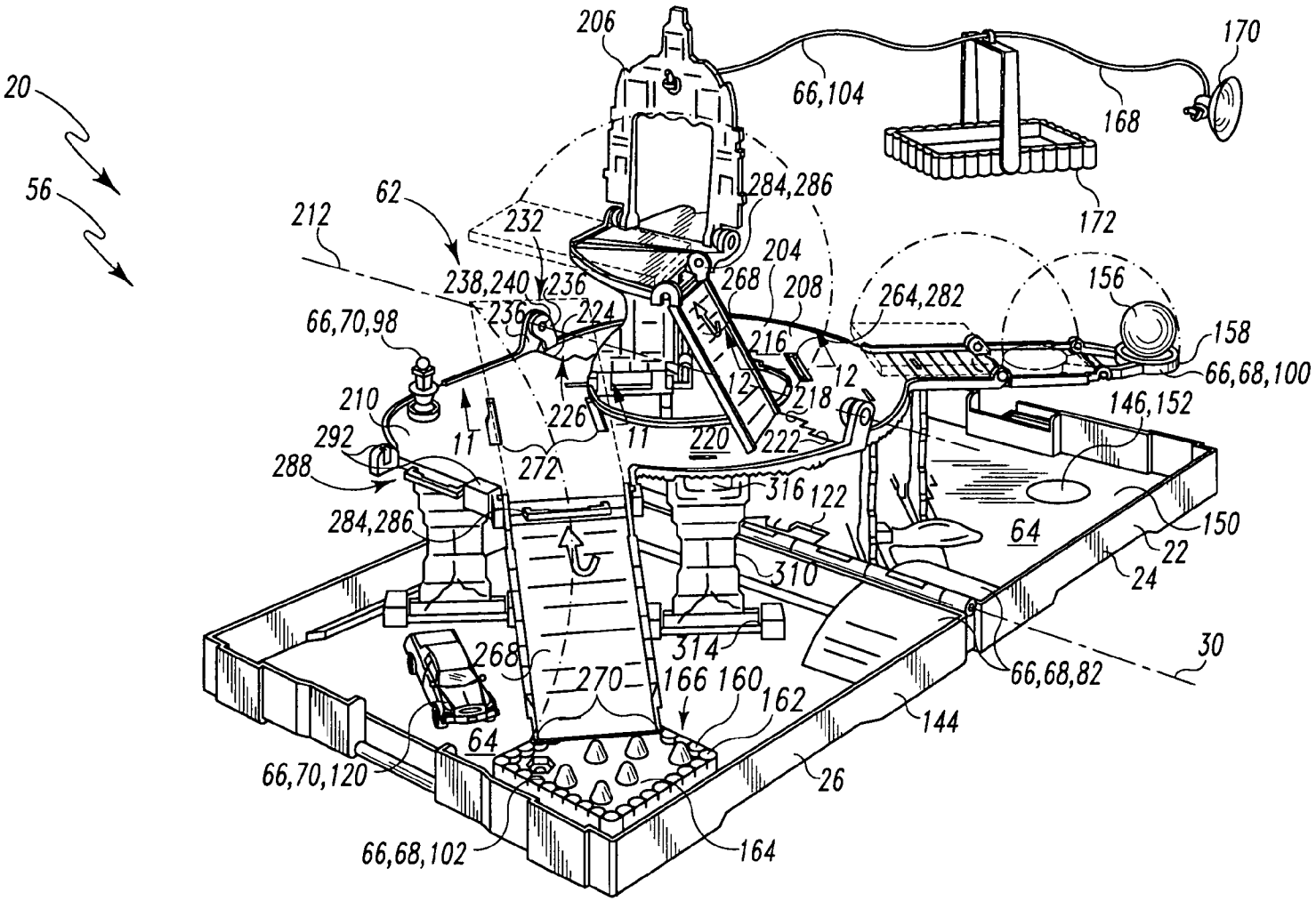

Playset 56, as shown in FIG. 4, includes a launching platform 100 that is formed integrally with the pop-up structure 62 of the playset. Launching platform 100 may be adapted to be folded out from the pop-up structure by a user. Moreover, the launching platform may be biased towards a raised position, such that, when an object such as a boulder 156 is placed within an end portion 158 and the launching platform is lowered, the object may be propelled airborne.

Playset 56, as shown in FIG. 4, also includes spring-loaded trap 102 and zip line 104. The spring loaded trap may include one or more pins 160 that are positioned within a base 162 such that the pins are adapted to move between a lowered position in which the tops of the pins are approximately level with a top surface 164 of the base and a raised position in which the pins extend above the top surface, as shown. In one embodiment, the pins may be biased toward the raised position, and may be adapted to be retained in the lowered position by a retention mechanism (not shown) until actuator button 166 is pressed either directly by a user, or by an accessory such as one or more vehicles 120 contacting the actuator.

Zip line 104 may include a line representing a cable 168 that may be suspended between pop-up structure and a wall, cabinet, or other suitable erect surface external to the playset. The zip line may include a suction cup 170, which may be adapted to attach the cable to the substantially erect surface, and a movable platform 172, which may be suspended from cable 168. The movable platform may be adapted to transport one or more accessories 66, such as vehicle 120, to or from the pop-up structure during play activities with playset 56.

Figure 5:
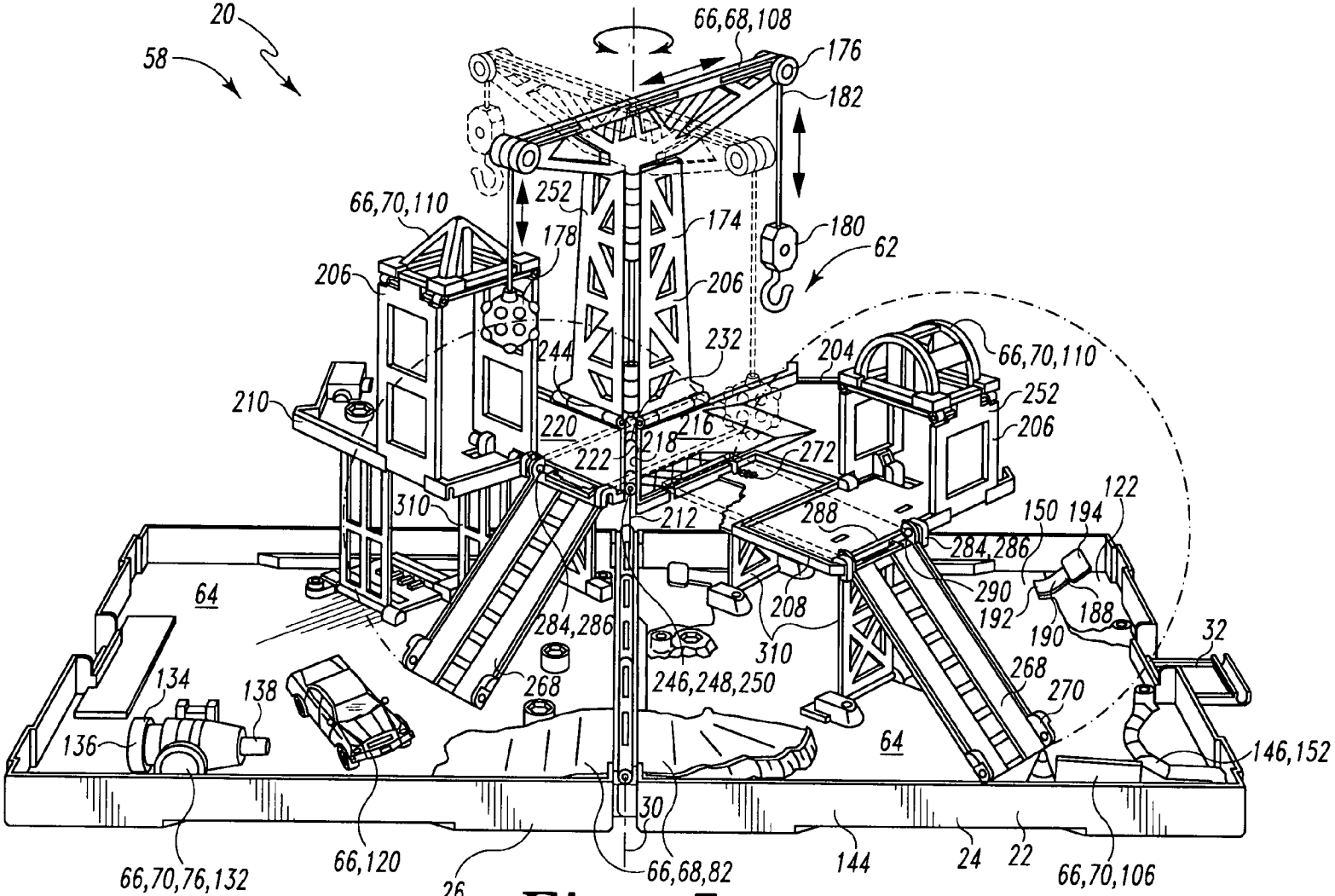

Playset 58, as shown in FIG. 5, includes crane 108. The crane may include a tower 174 and a boom 176 rotatably attached to the tower. Boom 176 may be coupled to a wrecking ball 178 and a hook 180 with cable 182. The relative lengths of cable 182 associated with wrecking ball 178 and/or hook 180 may be adjustable. As shown in FIG. 5, cable 182 may be pulled back and forth through boom 176 to adjust the relative lengths of the cable. Accordingly, a user may transport one or more accessories 66 such as roof trusses 110 using hook 180, or knock over accessories or elements of the pop-up structure using wrecking ball 178 by manipulating crane 108 during play with playset 56.

Figure 6:
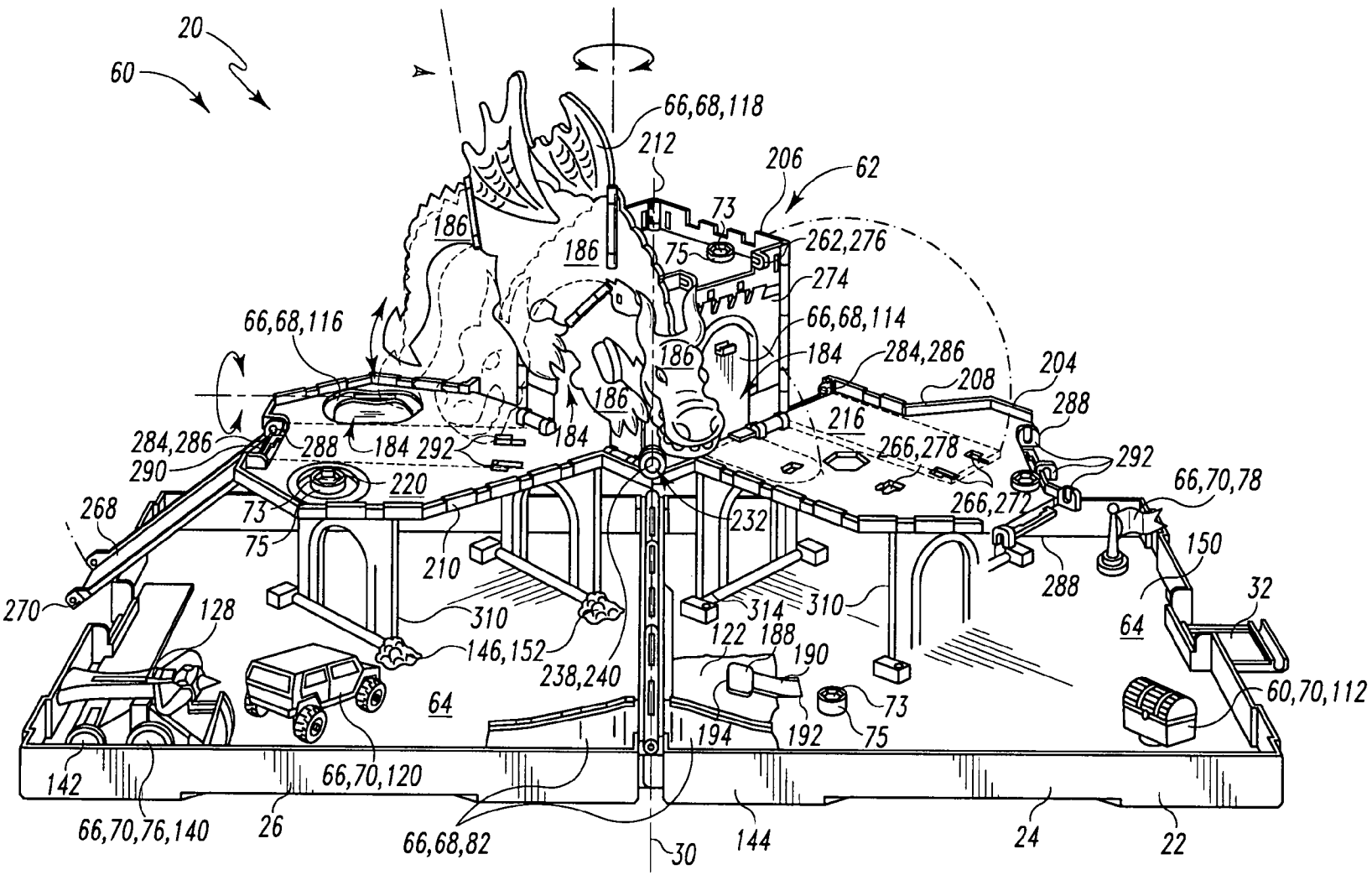

Playset 60, as shown in FIG. 6 includes door 114, trap door 116 and dragon 118. These accessories may be pivotably coupled to pop-up structure 62 to allow other accessories, such as vehicles 120 to pass through one or more openings 184. Moreover, these accessories may include a latch mechanism to retain the accessory in a position in which it is blocking the corresponding opening. Additionally, dragon 118, or any other accessory 66, may include other manipulatives 186 to enhance the play value of playsets 20, such as hinges and movable parts at the mouth, the neck, the legs, and the tail of the dragon.

Playsets 20 may include at least one playset-accessory retention chamber 122 that may include an arm 188 that has a resilient portion 190 disposed between a first end 192 and a second end 194. The first end may be attached to support surface 64 of shell 22. The resilient portion may be adapted to urge the second end from a displaced position spaced apart from the support toward a rest position adjacent to the support surface. Shown more particularly in FIG. 8, the arm may be configured such that a width 196 of the resilient portion is wider than a width 198 of second end 194. Additionally or alternatively, arm 188 may be operatively coupled or formed integrally with surface liner 150.

The playset-accessory retention chamber may also include a barrier 200 that may be mounted on the support surface spaced apart from and facing the arm. Barrier 200 may include a portion of perimeter 144 of shell 22. Accordingly, at least a portion of the barrier may be substantially perpendicular to the support surface.

Figure 8:
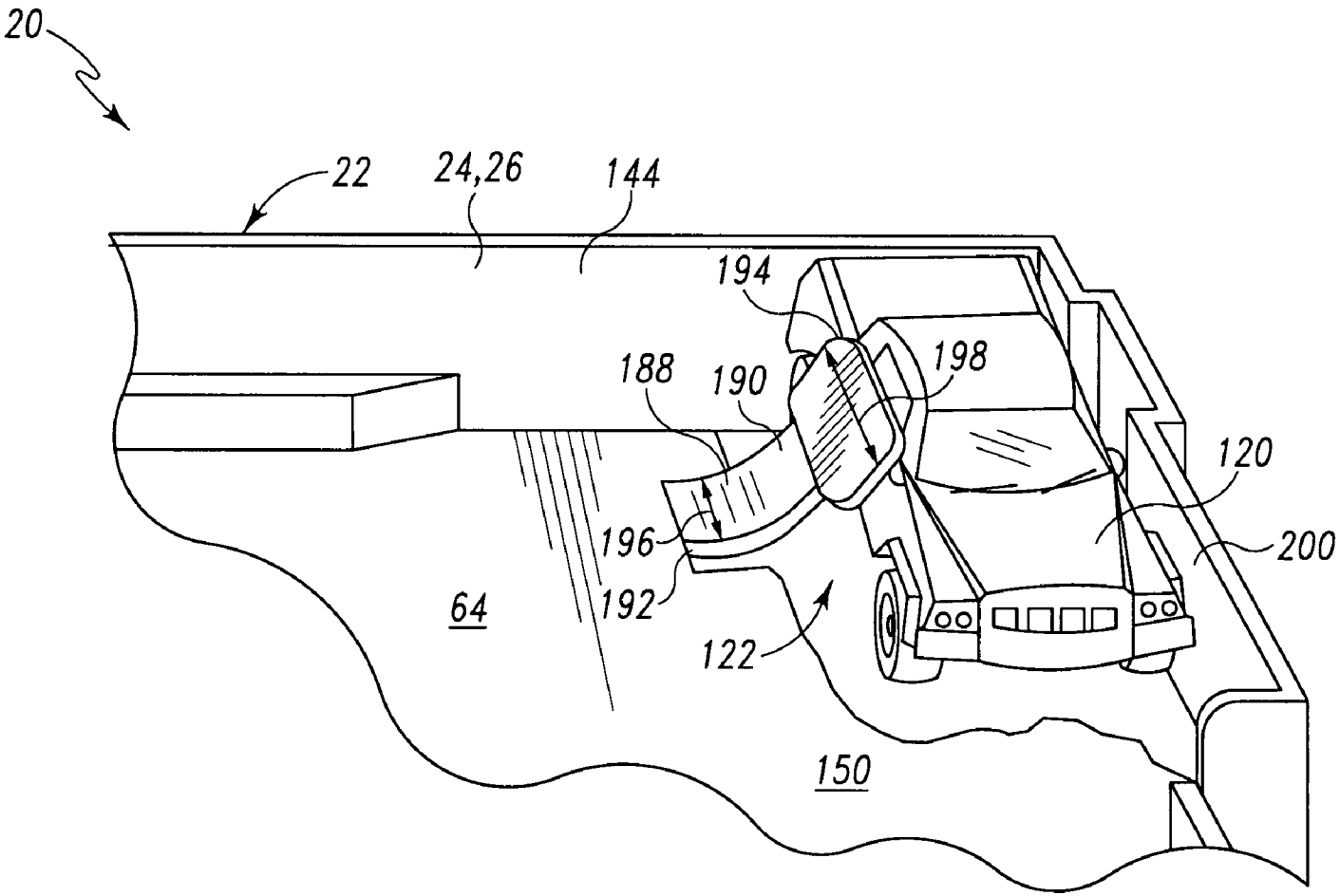
FIG. 8 is a partial perspective view of a playset-accessory retention chamber of the present disclosure retaining an exemplary playset accessory.

FIG. 8 shows an illustrative playset-accessory retention chamber 122 with a playset accessory, specifically, a vehicle 120, retained inside. Arm 188 is shown in the displaced position in which resilient portion 190 is urging second end 194 toward the rest position. Because vehicle 120 has been positioned within the playset accessory retention chamber, second end 194 is adapted to abut a side of the vehicle and to bias the vehicle against barrier 200. In this manner, playset-accessory retention chamber 122 may be adapted to retain an accessory such as a vehicle 120 when playset 20 is transitioned to the folded configuration, inverted, transported, etc.

Figure 9:
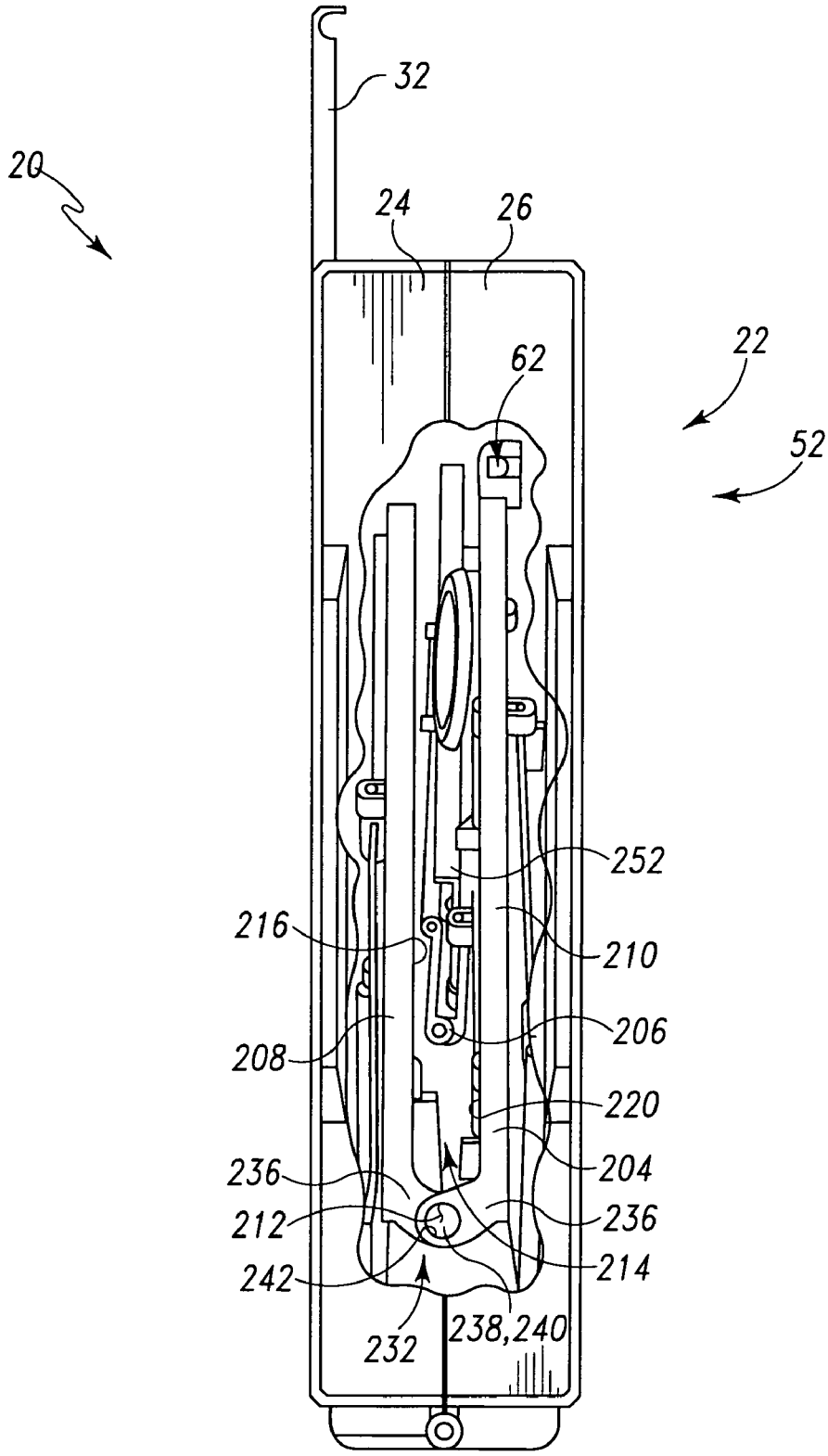
FIGS. 9-10 are cutaway side views of playsets of the present disclosure in closed positions.
Figure 10:
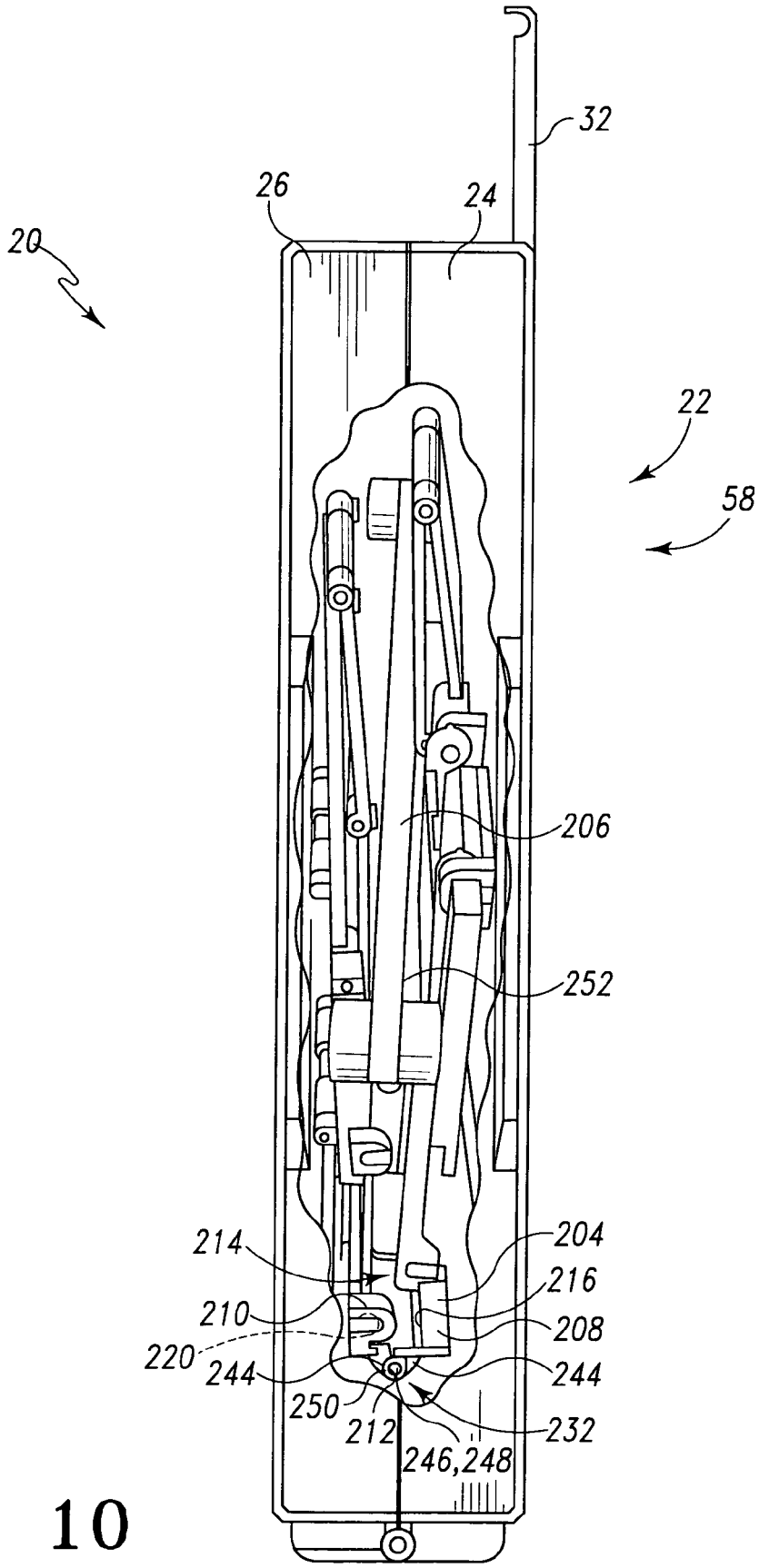

Returning now to FIGS. 2-7, pop-up structure 62 may include a platform 204 and one or more erect assemblies 206. Platform 204 may be substantially parallel to or otherwise extend along support surface 64 when the pop-up structure is in the deployed configuration. The platform may be formed from a first platform member 208 and a second platform member 210 that is hingedly coupled to the first platform member at a platform hinge axis 212. When the pop-up structure is in the stowed configuration, as illustrated in FIGS. 9-10, the platform may be configured such that the first platform member is substantially parallel to the second platform member and is positioned at a distance from the second platform member to form a gap 214.

Similarly, first platform member 208 may include a first surface 216 and a first edge 218 and second platform member 210 may include a second surface 220 and a second edge 222. Platform 204 may be configured such that, when pop-up structure 62 is in the deployed configuration, the first edge may abut the second edge, and the first surface may be continuous with the second surface. In some embodiments, such as those shown in FIGS. 3-4, platform 204 may include at least one tab 224 that may be adapted to fit matingly within at least one corresponding indentation or aperture 226 to align the first and the second platform members. In other embodiments, such as the embodiment shown in FIG. 2, platform 204 may include at least one tab 228 that matingly abuts a bottom surface 230 to align the first and the second platform members. It is within the scope of this disclosure that tabs 224 and 228 as well as apertures 226 be included with either or both platform members 208 and 210, that platforms 204 include a mixture of these or different alignment mechanisms, or that no alignment mechanism be used. In some embodiments, platform 204 may be substantially parallel to support surface 64 when the pop-up structure is in the deployed configuration.

Pop-up structure 62 may include a platform hinge element 232 that couples first platform member 208 to second platform member 210. Platform hinge element 232 may be adapted to pivot the second platform member about the first platform member along a platform hinge axis 212. The platform hinge axis may be spaced away from one or both platform members. In some embodiments, platform hinge element 232 may include one or more arm portions 236 that are operatively coupled to, or formed integrally with, one or both platform members. In these embodiments, the platform hinge element may also include a connecting member 238 that is adapted to pivotably couple the platform members. Connecting member 238, as shown in FIG. 9 may be a rigid pin 240 that is inserted within an aperture 242 on each arm portion 236.

In some embodiments, platform hinge element 232 may include a ridge portion 244 that may be operatively coupled to, or formed integrally with, each of the platform members. In these embodiments, a connecting member 246 may be adapted to pivotably couple ridge portions 244. Connecting member 246, as shown in FIG. 10, may be a rigid bar 248 that is inserted within a channel 250 formed in interdigitated portions of ridge portions 244.

Erect assembly 206 may include a plurality of elements 252 that are adapted to be transitioned between an erect configuration in which the erect assembly stands transversely from platform 204 and/or support surface 64 and a stowed configuration in which the elements are collapsed between the shell members. Alternatively, the elements of the erect assembly may be adapted to extend within gap 214 when the pop-up structure is in the stowed configuration.

Figure 11:
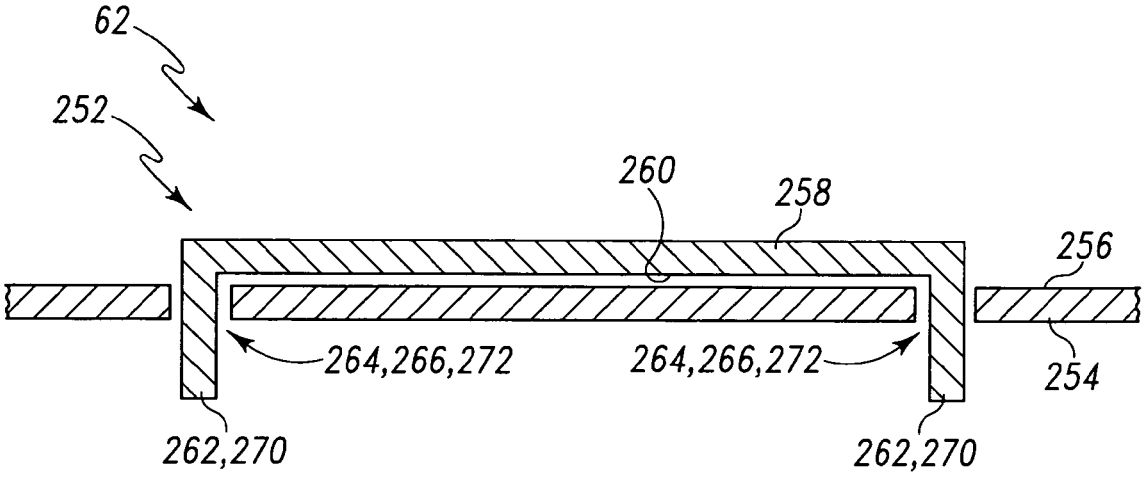
FIGS. 11-12 are cross-section views of first and second members of pop-up structures of the present disclosure.
Figure 12:
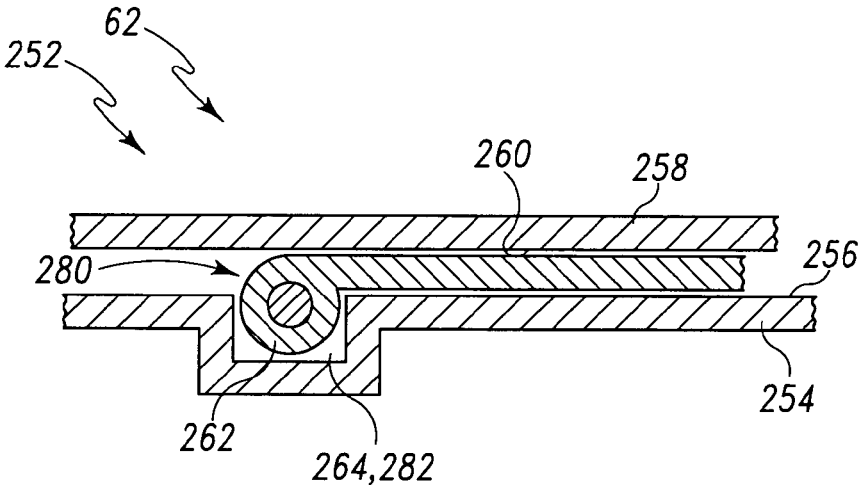

Pop-up structure 62 may include one or more elements that enable elements 252 to be collapsed compactly to reduce the overall thickness of erect assembly 206 and/or the entirety of pop-up structure 62 when it is in the stowed configuration. For example, as shown in FIGS. 11-12, the pop-up structure may include a first member 254 having a first surface 256 and a second member 258 having a second surface 260. When pop-up structure 62 is placed in the stowed configuration, the second member may be adapted to be placed adjacent to the first member with the second surface against the first surface. Second surface 260 may include a protrusion 262 that may be inserted into a receiving portion 264 formed on first surface 256, or within first member 254.

In some embodiments, receiving portion 264 may include an aperture 266 formed within first member 254. One example of aperture 266 and protrusion 262 may be included with the playsets 20 shown in FIGS. 3-6, and is shown more particularly in FIG. 11. These figures show second members 258, embodied by ramps 268, that each include at least one protrusion 262, embodied by ramp protrusions 270. These figures also show first members 254, embodied by first and/or second platform members 208, 210, that each include at least one corresponding aperture 266, embodied by ramp apertures 272. When the pop-up structure is in the stowed configuration, each ramp may be placed against the corresponding platform member, with the ramp protrusions inserted into the ramp apertures.

In some examples, second members 258, or more particularly, ramps 268, may be adapted to moved selectively by a user between a folded position in which the second member is placed against the first member with the second surface against the first surface and the protrusion (ramp protrusion 270) is inserted into the receiving portion (ramp aperture 272) and an unfolded position in which the second surface is separated from the first surface. In other examples, the second member may be adapted to move from the folded position automatically to the unfolded position during the deployment of pop-up structure 62.

For example, second members 258, or more particularly one or more erect assembly elements 252 such as castle wall 274 shown in FIG. 6 may be adapted to be placed adjacent to platform members 208, 210 when pop-up structure 62 of playset 60 is moved to the stowed configuration. The castle wall, as can be seen in FIG. 6, includes a wall protrusion 276 that may be adapted to be inserted into a platform aperture 278 that may formed on one of the platform members 208, 210 when the pop-up structure is transitioned to its folded configuration.

Figure 3:
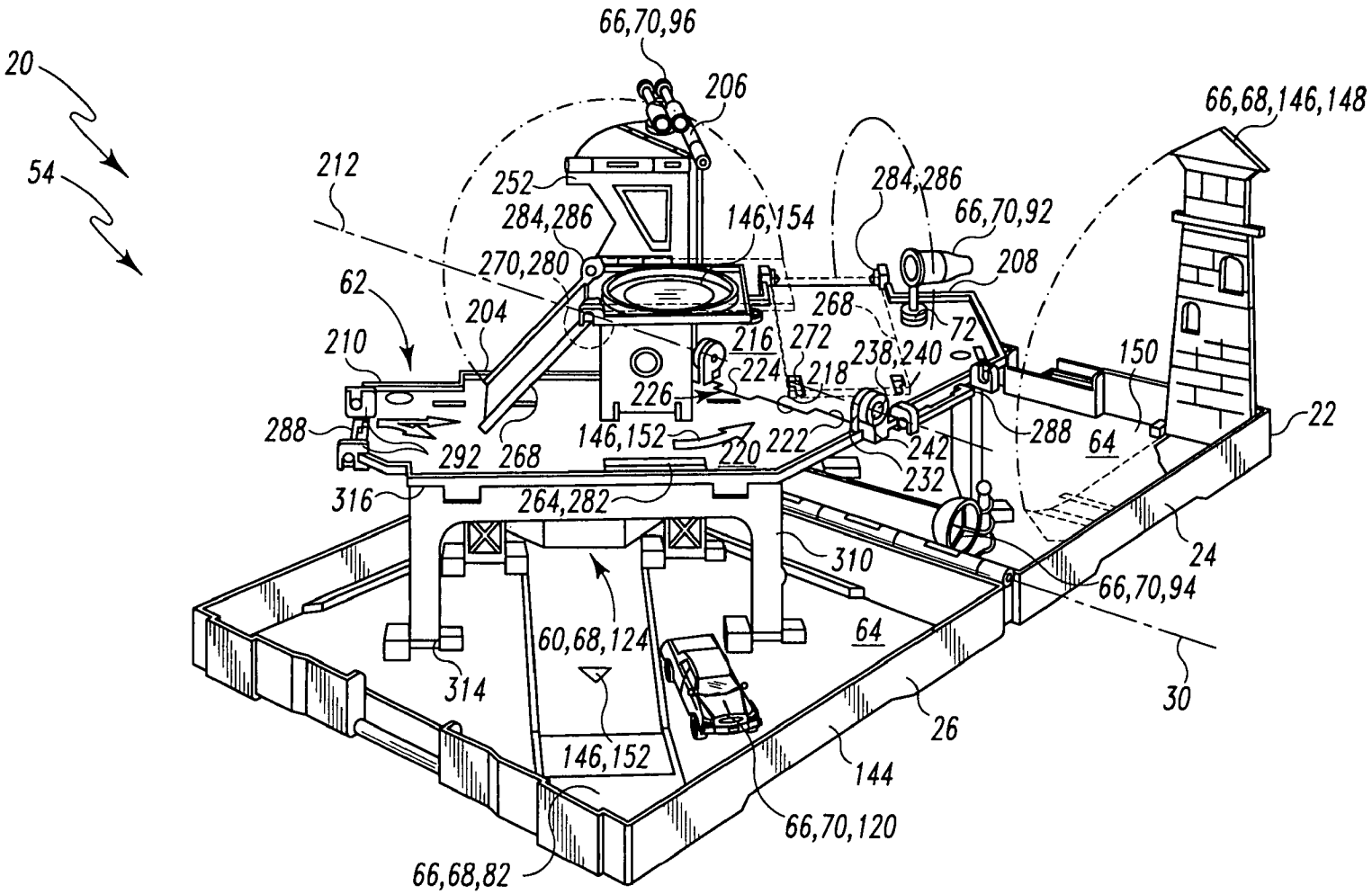

Another example of one or more erect assembly elements 252 embodying second member 258 is shown in the playsets 20 of FIGS. 3-4, and more particularly in FIG. 12. Specifically, the erect assembly elements may form a hinge 280, a portion of which may be adapted to be inserted into receiving portion 264, specifically a recessed portion 282 of first surface 256 and/or first member 254, embodied by platform members 208, 210. Recessed portions 282 may have any shape, such as the rectangular indentation shown in FIG. 3, or the rounded indentation shown in FIG. 4. It is within the scope of this disclosure that protrusions and receiving portions may be disposed in multiple locations, and may assume multiple forms, such as notches, cutouts, gaps, and so forth, and that protrusions and receiving portions may assume various regular and/or irregular shapes. Moreover, pop-up structure 62 may include a plurality of first members and second members, having a plurality of first and second surfaces, and a plurality of protrusions and corresponding receiving portions. Additionally, each first and second member may have any suitable number of protrusions and corresponding receiving portions.

Figure 13:
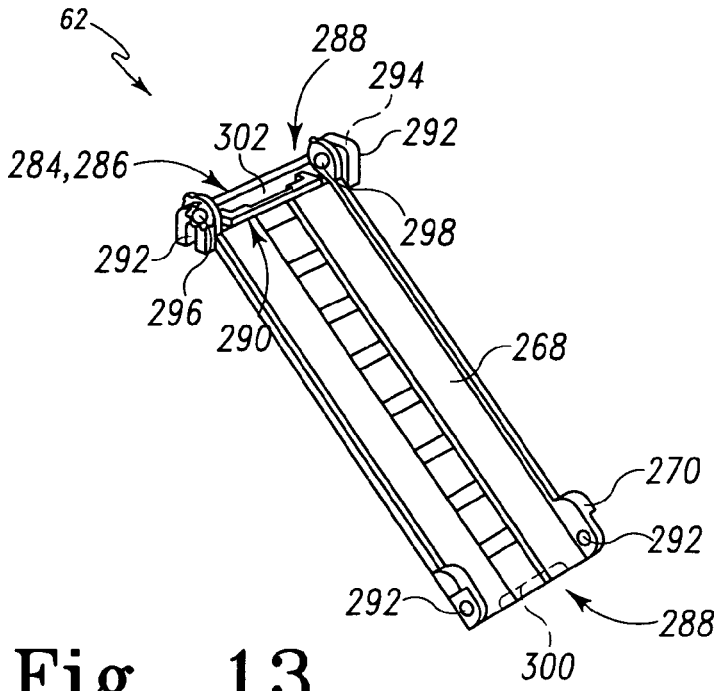
FIG. 13 is a partial perspective view of a pop-up structure of the present disclosure.

Ramps 268, as shown in FIGS. 2-6 and more particularly in FIG. 13, may be hingedly coupled to pop-up structure 62, or more specifically, to platform 204. Accordingly, the pop-up structure may include at least one hinge joint 284. In some embodiments, ramps 268 may be removably coupled to pop-up structure 62 as well. Pop-up structures of these embodiments, accordingly, may include one or more removable hinge joints 286, which may include a ramp acceptor 288 and a connector 290. In the embodiments illustrated in the drawings, ramp acceptor 288 is embodied by one or more notches 292 on platform 204 and/or other locations on pop-up structure 62. Connector 290 is embodied by one or more pins 294 disposed on ramps 268.

Pin 294 may include in outer portion 296 that may be adapted to mate with notch 292 and an inner portion 298 that may be adapted to mate with an alternate ramp acceptor 288, which 5 may be present on another ramp 268 as part of ramp protrusions 270, or on any other suitable location on pop-up structure 62. To enhance the play value of playsets 20, platform 204, or pop-up structure 62, may include any number of ramp acceptors, and a playset 20 may include a greater number of ramp acceptors than ramps, leaving the location of connection of each ramp up to the user. Ramp acceptors 288 may be disposed in any position and at any orientation relative 10 to platform hinge axis 212. It is within the scope of this disclosure that ramp acceptors 288 and connectors 290 include any suitable mechanisms to mate the ramps to the pop-up structure, including reversing the positioning of the notches and the pins, and the like.

Ramps 268 maybe adapted to connect to pop-up structures in other ways. As shown in FIGS. 4-5, one or more ramps may include a tab 300 that is adapted to fit within a slot 302. In the embodiments shown, several slots 302 are disposed between notches 292 on ramp acceptors 288. Additionally, playset 56 of FIG. 4 includes a slot 302 in platform 204 that is adapted to secure selectively one or more ramps 268 in a deployed position while pop-up structure 62 is in the deployed configuration. Playset 56 also includes a slot 302 in base 162 to secure selectively one or more ramps 268 in position while pop-up structure 62 is in the deployed configuration.

In other embodiments, slots 302 may be disposed in any suitable location, such as on other locations on platform 204, or on another ramp (not shown). In this way, a user may connect a first fold-out playset with pop-up structures 20 to another playset, which may be a second playset 20, or any other playset having compatible mating connections, thereby enhancing play value of playsets 20.

Figure 14:
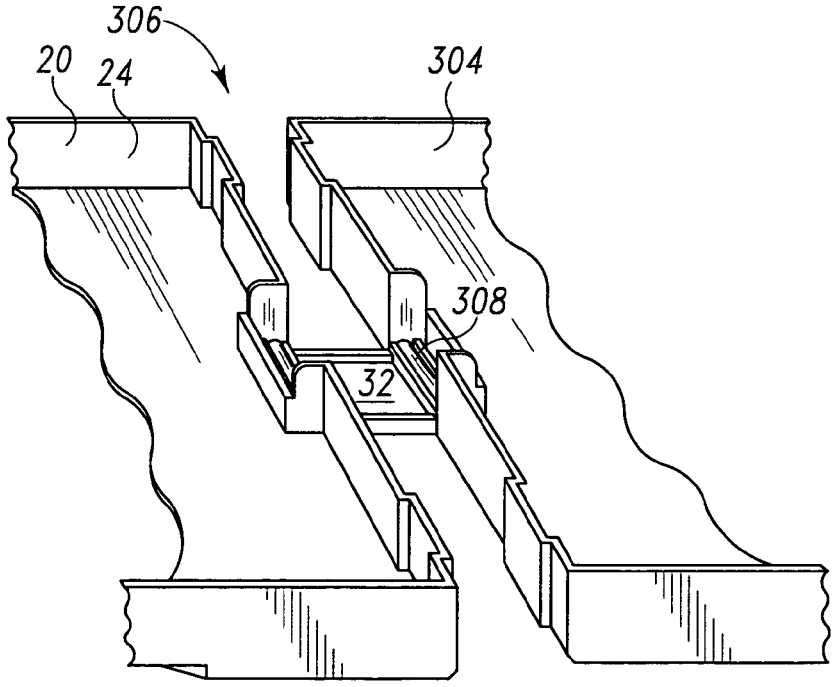
FIG. 14 is a partial perspective view of a playset system of the present disclosure showing a fastener in a linking position between a first and a second playset.

FIG. 14 shows an additional manner in which a first playset 20 may connect with a second playset 304, thereby forming a playset system 306. As has been mentioned previously, playsets 20 may include a clasp or fastener 32 that may be adapted to retain the playset in the closed configuration, and/or may be adapted to link the playset to another playset or toy.

Fastener 32 may be adapted to be selectively moved between the clasping position shown in FIG. 1 and the linking position shown in FIG. 14, in which the fastener is coupled to second playset 304. Playset 304 may include a bar 308 that may be adapted to couple the fastener to the second playset. In some examples, first shell member 24 may be spaced apart from second playset 304 when fastener 32 is operatively coupled to the second playset.

With continued reference to FIGS. 2-6, pop-up structures 62 may include a plurality of standards 310 that are hingedly coupled to one or both shell members 24, 26, or to support surface 64 at a bottom end 314. The standards may also be hingedly coupled to platform members 208, 210 at a top end 316. As has been previously discussed, when shell members 24, 26 are in the closed configuration, pop-up structure 62 may be in the stowed configuration, in which the standards may extend along one or both of support surface 64 and platform members 208, 210. Similarly, when shell members 24, 26 are in the open configuration, standards 310 may extend transversely from the shell members and/or support surface 64.

Figure 15:
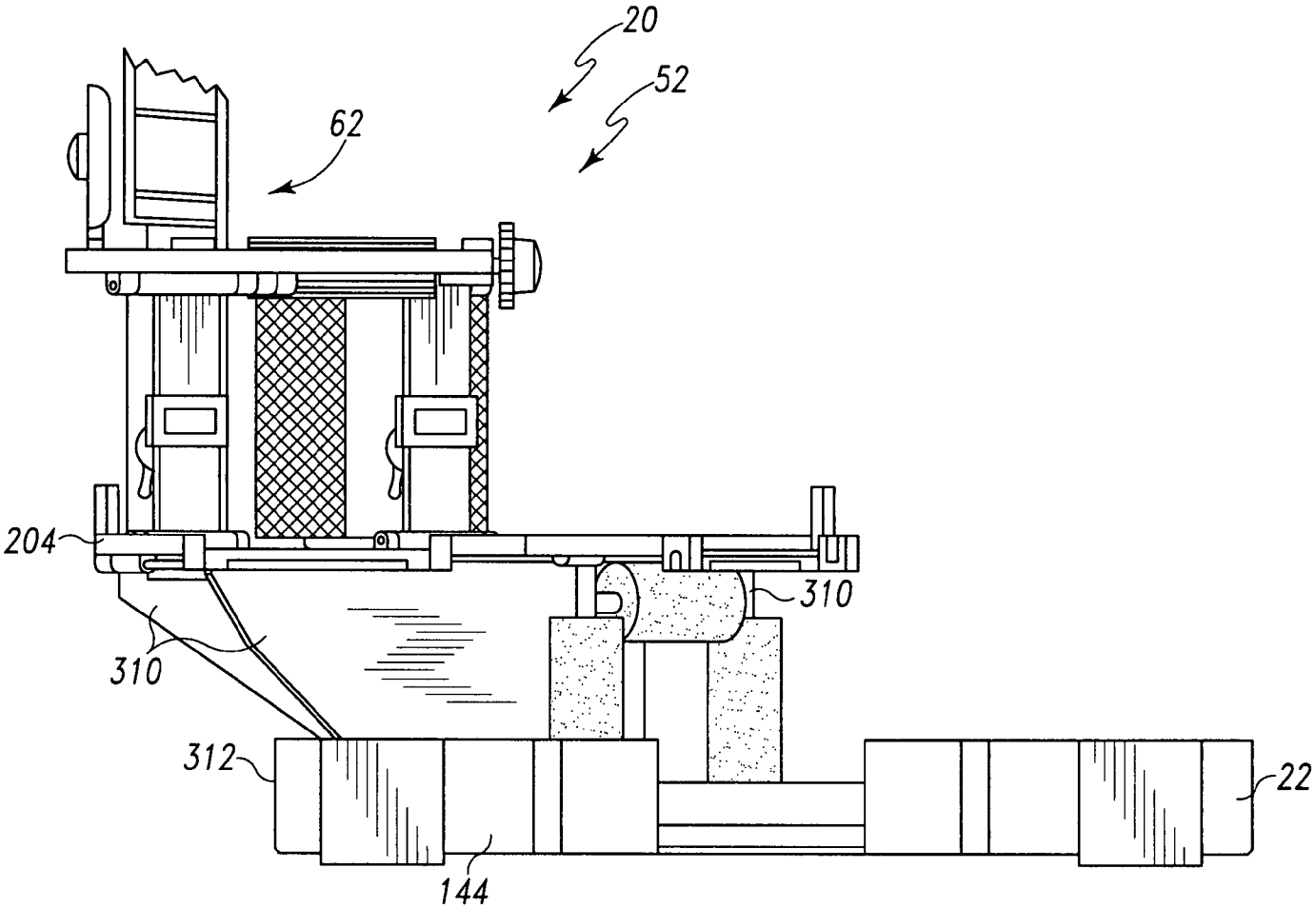
FIG. 15 is a side view of the playset of FIG. 2 in an open configuration.

The coupling of standards 310 to shell 22 may define a standard axis that forms an acute angle with shell hinge axis 30 and/or one or more components of shell perimeter 144, such as back wall 312. For example an angle of 45 degrees may be used. As illustrated in FIG. 15, platform 204 may be configured such that at least a portion of the platform extends outside of shell perimeter 144 when the pop-up structure is in the deployed configuration. In some embodiments, shell hinge axis 30 may be substantially parallel to platform hinge axis 212, as can be seen in FIGS. 2-6.

Figure 16:
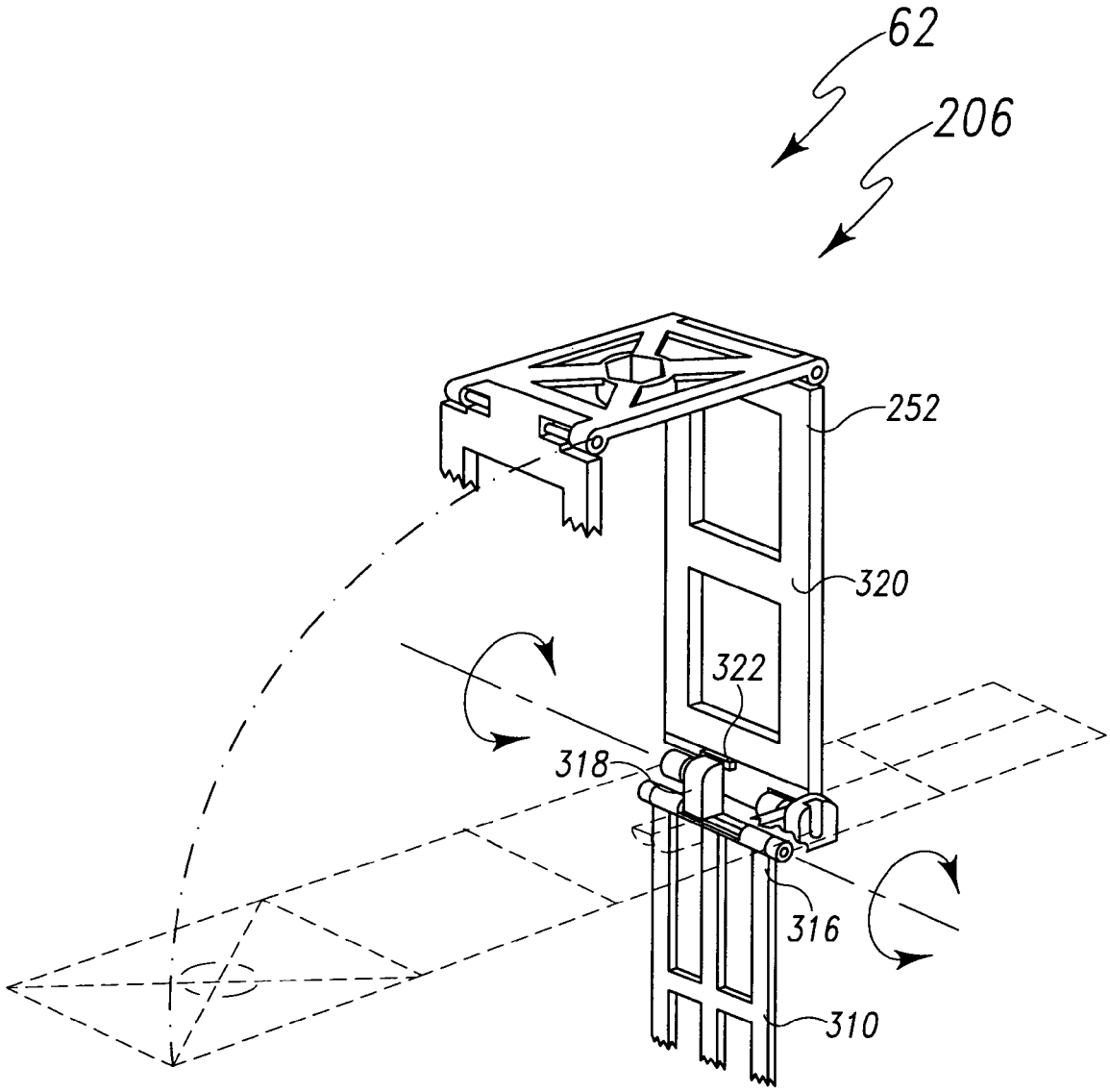
FIG. 16-17 are cutaway partial perspective views of assemblies of pop-up structures of the present disclosure.
Figure 17:
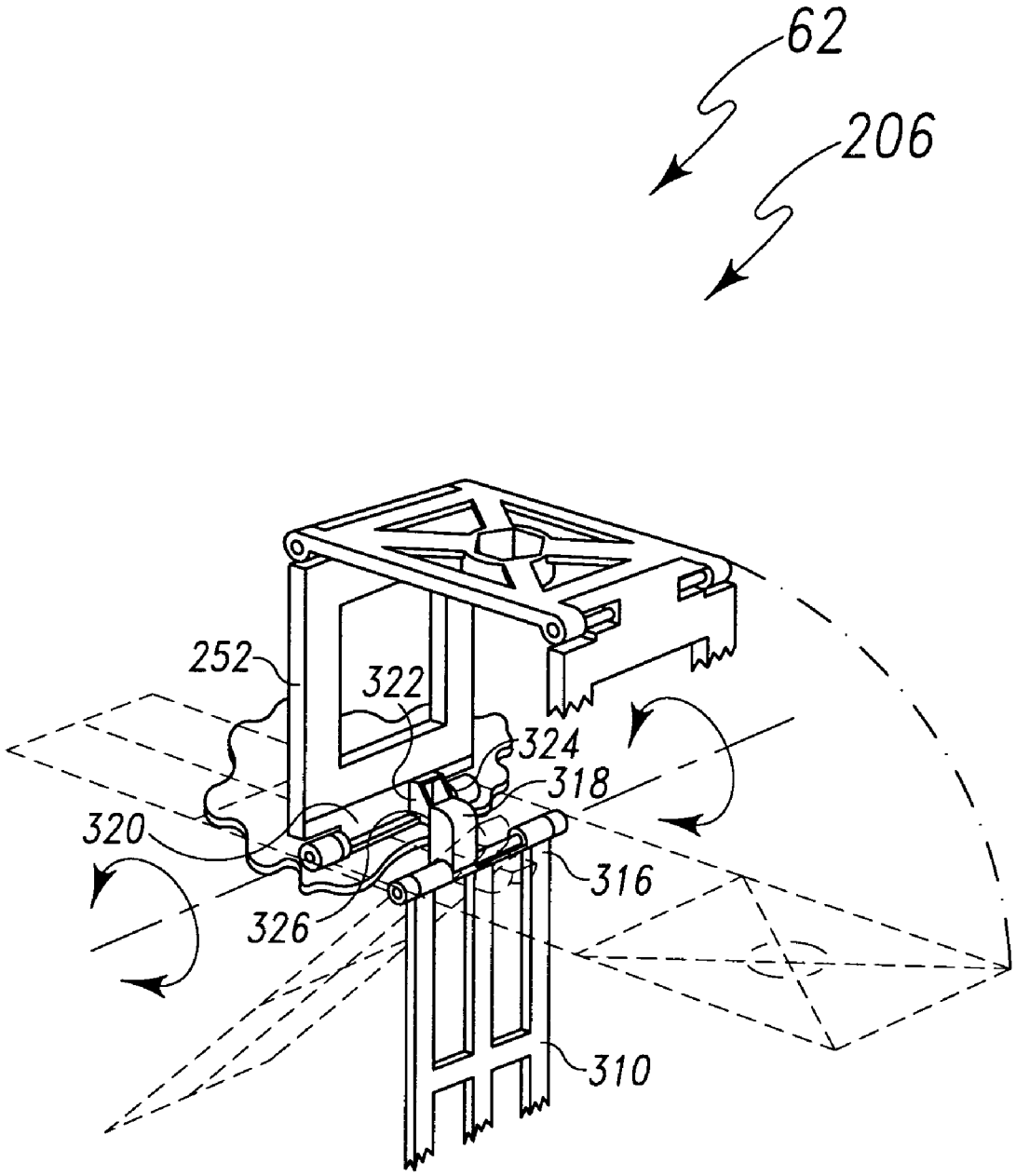

Turning now to FIGS. 16-17, pop-up structures 62 may include one or more elements that urge the pop-up structure itself, or various subcomponents such as one or more erect assemblies 206 toward the deployed or erect configuration. For example, standards 310 may be adapted to urge erect assembly 206 toward the erect configuration. For example, top end 316 of one or more standards may include a tab 318 that is adapted to press against at least one erect assembly element 252. In some examples, the at least one erect assembly element may have a surface 320 and a projection 322 from the surface. The projection may be aligned with the tab, as shown in FIGS. 16-17, and may have any suitable profile. For example, FIG. 16 shows a first profile for projection 322 in which tab 318 is adapted to urge erect assembly 206 directly toward the erect configuration. In contrast, FIG. 17 shows a second profile for projection 322 that urges the erect assembly to an intermediate erect position as tab 318 presses against sloped face 324, and to a fully erect position as tab 318 presses against vertical face 326. In some embodiments, tab 318 may be formed from a resilient material.

Figure 18:
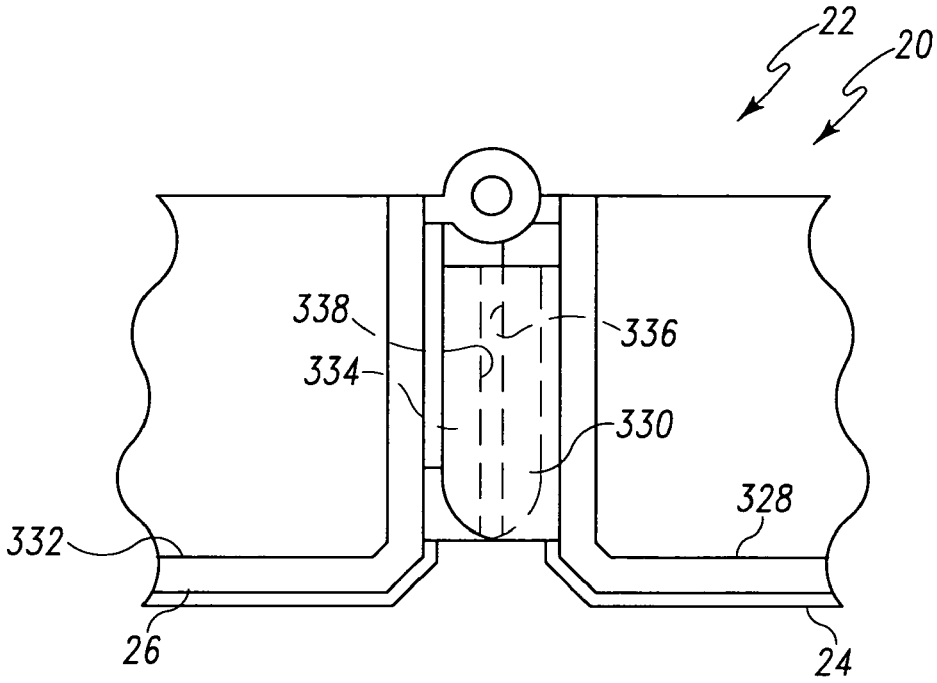
FIG. 18 is a partial side view showing first shell member with a first latch element and a second shell member with a second latch element of the present disclosure in an open position.
Figure 19:
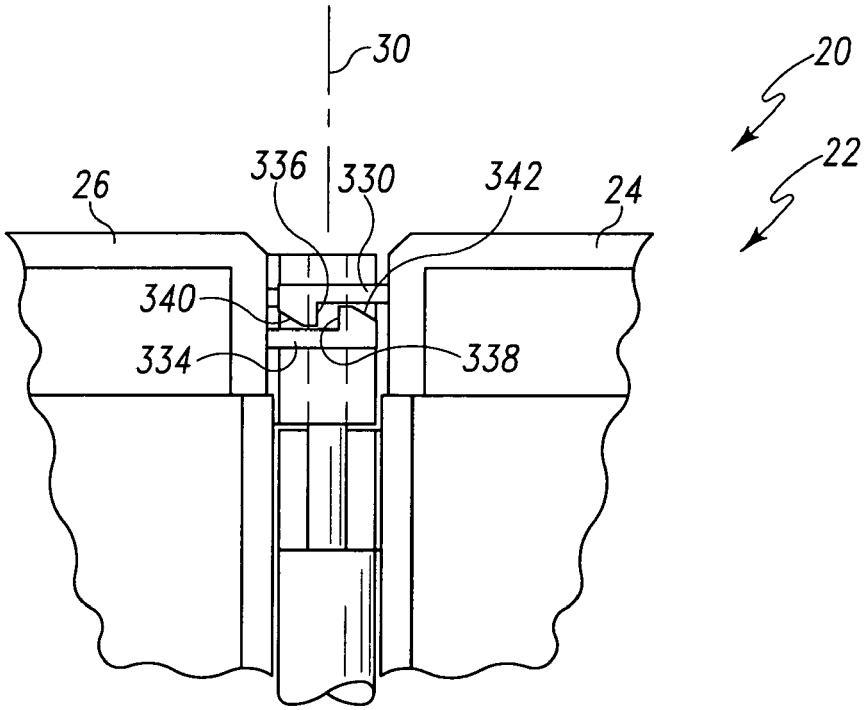
FIG. 19 is a bottom view of the playset components shown in FIG. 18.

Turning now to FIGS. 18-19 a portion of playsets 20 is shown. First shell member 24 may include a first surface 328 and a first latch element 330. Similarly, second shell member 26 may include a second surface 332 and a second latch element 334. As has been discussed previously, the second shell member may be movable relative to the first shell member between the closed position in which the first surface faces the second surface, and an open position in which the surfaces face a common direction. In some embodiments, the second latch element may engage the first latch element when the second latch element is in the open position, thereby retaining the second shell member in the open position. Playset 20 may include any number of second latch elements that each pair-wise engage a corresponding first latch element. For example, two latch element pairs may be used.

As shown in FIGS. 18-19, first latch element 330 has a first edge 336 and second latch element has a second edge 338 that may be adapted to engage the first edge when the second latch element engages the first latch element. The first latch element may have a first sloped face 340 and the second latch element may have a second sloped face 342. When the second shell member is moved to the open position, the first sloped face may be adapted to abut the second sloped face and to oppose the bias on the second latch element. In some embodiments, the second latch element may be biased towards the first latch element and/or may be formed from a resilient material. In other embodiments, the first latch element may be formed integrally with at least a portion of shell hinge 28. When the playset is transition from the open position, the second edge may be adapted to abut the first edge and to oppose the bias on the second latch element to release the engagement between the latch elements.

Fold-out playsets with pop-up structures may be constructed from any suitable material or materials such as plastic, wood, cardboard, or metal. Various components may be fabricated from different materials, and may be colored and/or decorated with dye, paint, or applied decals to add play value to the playsets.

This disclosure may include one or more independent or interdependent inventions directed to various combinations of features, functions, elements and/or properties. While examples of apparatus and methods are particularly shown and described, many variations may be made therein. Various combinations and sub-combinations of features, functions, elements and/or properties may be claimed in one or more related applications. Such variations, whether they are directed to different combinations or directed to the same combinations, whether different, broader, narrower or equal in scope, are regarded as included within the subject matter of the present disclosure.

The described examples are illustrative and directed to specific examples of apparatus and/or methods rather than a specific invention, and no single feature or element, or combination thereof, is essential to all possible combinations. Thus, any one of various inventions that may be claimed based on the disclosed example or examples does not necessarily encompass all or any particular features, characteristics or combinations, unless subsequently specifically claimed. Where "a" or "a first" element or the equivalent thereof is recited, such usage includes one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically indicated.

INDUSTRIAL APPLICABILITY

The methods and apparatus described in the present disclosure are applicable to toys, games, and other devices, and industries in which amusement devices are used.

We claim:

1. A playset, comprising:

a playset-accessory;

a support surface;

an arm having a first end attached to the support surface, a second end, and a resilient portion between the first and second ends, the resilient portion of the arm urging the second end from a displaced position spaced from the support surface toward a rest position adjacent to the support surface; and a barrier projecting from the support surface spaced from and facing the arm, the arm and barrier together forming a retention chamber for the playset-accessory when the second end of the arm is in the displaced position.

2. The playset of claim 1, wherein the resilient portion has a width and the second end has a width that is wider than the width of the resilient portion.

3. The playset of claim 1, further comprising a shell having a perimeter, wherein at least a portion of the barrier includes a portion of the perimeter.

4. A playset, comprising:

a first shell member including a first surface and a first latch element;

a second shell member operatively coupled to the first shell member and including a second surface and a second latch element, the second shell member being adapted to move relative to the first shell member between a closed position in which the first surface faces the second surface and an open position in which the first surface and the second surface face a common direction, the second latch element being adapted to engage the first latch element when the second shell member is in the open position to impede movement of the second shell member from the open position toward the closed position.

5. The playset of claim 4, including at least two second latch elements that each engage a corresponding one of at least two first latch elements.

6. The playset of claim 4, wherein the first latch element has a first edge, wherein the second latch element has a second edge that is adapted to engage the first edge when the second latch element engages the first latch element.

7. A playset, comprising:

a support surface; and a pop-up structure coupled to the support surface and adapted to be transitioned between a stowed configuration in which the pop-up structure extends along the support surface and a deployed configuration in which the pop-up structure stands substantially transverse to the support surface, the pop-up structure including:

a first member having a first surface with a receiving portion; and a second member having a second surface with a protrusion, the second member being adapted to be placed adjacent to the first member with the second surface against the first surface and the protrusion inserted into the receiving portion when the pop-up structure is in the stowed configuration.

8. The playset of claim 7, wherein the receiving portion includes an aperture in the first surface.

9. The playset of claim 7, wherein the receiving portion includes a recessed portion in the first surface.

10. The playset of claim 7, wherein the second member is hingedly coupled to the first member, and the second member is adapted to be selectively moved between a folded position, in which the second member is placed adjacent to the first member with the second surface against the first surface and the protrusion inserted into the receiving portion, and an unfolded position, in which the second surface is separated from the first surface.

11. The playset of claim 7, wherein the pop-up structure includes:

a platform that is substantially parallel to the support surface when the pop-up structure is in the deployed configuration, wherein the platform includes the first member; and an erect assembly extending generally transverse to the platform when the pop-up structure is in the deployed configuration, wherein the erect assembly includes the second member.

12. A playset, comprising:

a support surface;

a pop-up structure coupled to the support surface and adapted to be selectively transitioned between a deployed configuration in which the pop-up structure stands substantially transverse to the support surface and a stowed configuration in which the pop-up structure is collapsed and extends along the support surface, the pop-up structure including:

a first member;

a second member hingedly coupled to the first member such that, when the pop-up structure is in the stowed configuration, the first member is substantially parallel to the second member and is positioned at a distance from the second member, such that there is a gap between the first member and the second member; and a third member that extends generally transversely from at least one of the first member and the second member when the pop-up structure is in the deployed configuration, wherein the third member extends within the gap when the pop-up structure is in the stowed configuration.

13. The playset of claim 12, wherein the first member has a first surface and a first edge, wherein the second member has a second surface and a second edge, and wherein, when the pop-up structure is in to the deployed configuration, the first edge abuts the second edge and the first member and the second member collectively form a platform with the first surface substantially continuous with the second surface.

14. The playset of claim 12, wherein the pop-up structure further includes a hinge element that couples the first member to the second member, the hinge element being adapted to pivot the second member about the first member along a hinge axis that is spaced away from at least one of the first surface and the second surface.

15. A playset, comprising:

a shell having first and second shell members, the shell members being adapted to be transitioned between a closed configuration in which the shell members are facing each other and an open configuration in which the shell members are spaced apart; and a pop-up structure that extends transversely from at least one shell member when the shell members are positioned in the open configuration, the pop-up structure including:

an assembly having a plurality of elements adapted to be transitioned between an erect configuration in which the assembly extends generally transversely from the at least one shell member when the shell members are in the open configuration and a stowed configuration in which the plurality of elements are in a collapsed configuration between the shell members when the shell members are in the closed configuration; and a standard operatively coupled to one of the shell members such that the standard extends transversely from the one shell member when the shell members are in the open configuration, the standard including a tab that is adapted to press against a first element of the plurality of elements to urge the assembly toward the erect configuration.

16. The playset of claim 15, wherein the first element includes a surface and a projection from the surface that is aligned with the tab.

17. A playset, comprising:

a shell having a perimeter; and a pop-up structure including a platform, the pop-up structure being operably coupled to the shell such that the pop-up structure transitions between a deployed configuration in which the pop-up structure stands substantially erect with at least a portion of the platform extending outside of the perimeter of the shell and a stowed configuration in which the pop-up structure is disposed within the perimeter, wherein the platform includes a first platform member and a second platform member hingedly coupled to the first platform member.

18. The playset of claim 17, wherein the shell has a support surface to which the pop-up structure is operatively coupled, and the platform has a surface that is substantially parallel to the support surface of the shell when the pop-up is moved to the deployed configuration.

19. A playset system, comprising:

two or more playsets, including at least a first playset and a second playset, the first playset being adapted to be transitioned between an open configuration and a closed configuration and comprising:

a first shell member;

a second shell member operatively coupled to the first shell member, the first and second shell members being configured to transition the first playset between the open configuration and the closed configuration; and a fastener pivotably coupled to the first shell member and adapted to be selectively moved relative to the first shell member between a clasping position in which the fastener is coupled to the second shell member thereby retaining the first playset in the closed configuration and a linking position in which the fastener is coupled to the second playset.

20. The playset system of claim 19, wherein the fastener is adapted to be removed selectively from the first shell member.

21. The playset system of claim 19, wherein the first shell member includes a first recess portion and the second shell member includes a second recess portion, and wherein the first and second recess portions collectively form a recess when the first playset is in the closed configuration, wherein the fastener nests in the recess when the fastener is coupled selectively to the second shell member.

22. The playset system of claim 19, wherein the first shell member is spaced from the second playset when the fastener is operatively coupled selectively to the second playset.

23. The playset system of claim 19, wherein the fastener is pivotable relative to the second shell member.

* * * * *

UNITED STATES PATENT AND TRADEMARK OFFICE

CERTIFICATE OF CORRECTION

PATENT NO. : 7,618,301 B2
APPLICATION NO. : 11/446404
DATED : November 17, 2009
INVENTOR(S) : Knight et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 424 days.

Signed and Sealed this

Nineteenth Day of October, 2010

David J. Kappos

David J. Kappos
*Director of the United States Patent and Trademark Office*